US007418897B2

(12) United States Patent
Balbo

(10) Patent No.: US 7,418,897 B2
(45) Date of Patent: Sep. 2, 2008

(54) WEAPON SYSTEM THAT CAN BE CARRIED BY A TRUCK

(75) Inventor: Patrick Balbo, Bourges (FR)

(73) Assignee: Giat Industries, Versailles (FR)

( * ) Notice: Subject to any disclaimer, the term of this patent is extended or adjusted under 35 U.S.C. 154(b) by 77 days.

(21) Appl. No.: 11/311,352

(22) Filed: Dec. 20, 2005

(65) Prior Publication Data

US 2006/0225567 A1 Oct. 12, 2006

(30) Foreign Application Priority Data

Dec. 28, 2004 (FR) ..... 04 13967

(51) Int. Cl.
*F41A 23/26* (2006.01)
*F41A 23/34* (2006.01)

(52) U.S. Cl. ..... 89/40.02; 89/37.13

(58) Field of Classification Search ..... 89/37.05, 89/37.13, 40.01, 40.02, 40.04, 40.08, 40.09, 89/40.11, 40.13, 40.14, 40.15, 40.16, 42.02; 414/561, 563, 631

See application file for complete search history.

(56) References Cited

U.S. PATENT DOCUMENTS 1,220,246 A * 3/1917 Loomis ..... 89/40.01
2,926,798 A * 3/1960 Hamilton ..... 414/680
4,175,904 A 11/1979 Airaksinen ..... 414/421
4,729,279 A * 3/1988 Collanus et al. ..... 89/40.13
5,007,791 A * 4/1991 Boughton ..... 414/494
5,604,327 A * 2/1997 Skoglund et al. ..... 89/46
6,457,396 B1 * 10/2002 Bean et al. ..... 89/40.04
6,742,435 B2 * 6/2004 Staiert et al. ..... 89/40.13
6,748,845 B2 * 6/2004 Staiert et al. ..... 89/40.13
2002/0050208 A1 * 5/2002 Staiert et al. ..... 89/40.02
2002/0148348 A1 * 10/2002 Staiert et al. ..... 89/40.02
2004/0216597 A1 11/2004 Kohlstedt et al. ..... 89/40.03

FOREIGN PATENT DOCUMENTS

EP 0012145 A1 6/1980
WO WO 02/061362 8/2002
WO WO 03025494 A1 * 3/2003

OTHER PUBLICATIONS

Anonymous: "Deutsche Flak 1930 bis 1945," URL: http://www.ww2technik.de/dflak_leicht.

* cited by examiner

*Primary Examiner*—Bret Hayes
(74) *Attorney, Agent, or Firm*—Steptoe & Johnson LLP

(57) ABSTRACT

A weapon system incorporating a cannon mounted in a cradle and intended to be carried on a vehicle wherein the cradle is integral with a plate able to be positioned on the ground by the vehicle using a maneuvering arm, the cannon being able to fire from the plate positioned on the ground.

9 Claims, 13 Drawing Sheets

WEAPON SYSTEM THAT CAN BE CARRIED BY A TRUCK

BACKGROUND OF THE INVENTION

1. Field of the Invention

Figure 1:
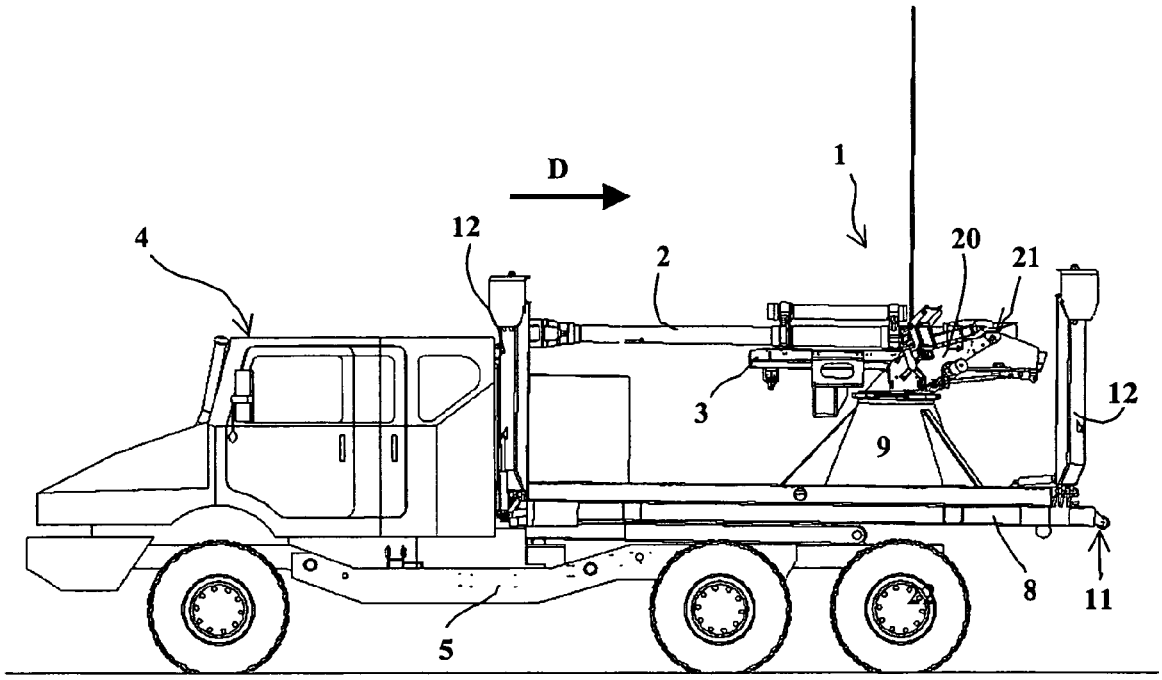

The technical scope of the invention is that of weapon systems and namely weapon systems mounted on a vehicle.

2. Description of the Related Art

It is well known for a weapon system to be associated with a vehicle. However, specific vehicles are generally implemented which have been designed to be able to carry the weapon system in question and which are namely able to withstand the firing stresses.

Thus, heavy or light armored vehicles, wheeled or tracked, and provided with a turret fitted with a cannon whose calibre may be between 75 mm and 155 mm are known.

155 mm artillery systems are also known which are mounted onto strengthened trucks from which they are able to fire thanks to the implementation of stabilizers or spades able to take up the firing stresses. These pieces of artillery have the advantage of being very mobile but the vehicle used has been modified and strengthened to enable the weapon to be fired.

Known systems are also relatively heavy (at least 18 tons) and their sheer bulk limits the possibilities of air transportation into theatres of operations.

It is also known, by patent WO02/061362 to transport classical artillery on a truck, then to unload it in the field. However, the deployment and withdrawal of such artillery takes a relatively long time and it is not possible to do this from the vehicle itself.

SUMMARY OF THE INVENTION

The aim of the invention is to propose a weapon system that ensures rapid deployment and substantial flexibility of use whilst enabling a conventional truck to be used and facilitating the air transportation of the system.

Thus, the invention relates to a weapon system incorporating a cannon mounted in a cradle and intended to be carried on a vehicle, wherein the cradle is integral with a base plate able to be placed on the ground by the vehicle using a maneuvering arm, the cannon being able to be fired from the plate on the ground.

The cradle will be advantageously mounted able to pivot on a support that is fixed with respect to the plate.

The plate may carry at least one pivoting stabilizer fixed to each of its angles.

Each stabilizer may incorporate an arm whose length and pivoting capacity will be sufficient to enable the end of the arm to press on the ground when the plate is carried by the vehicle.

The plate may carry at least one pivoting panel able to move from a transport position in which it is substantially perpendicular to the plate, to a service position in which it is substantially an extension of the plate.

Each panel may carry at least one guardrail able to be fastened in a perpendicular position to the panel when the latter is in its service position.

The plate may carry at least one projectile and/or propellant charge rack.

The cannon cradle may be pivoted in elevation and in traverse with respect to the support by motors means and the plate may carry at least one generator intended to power these motor means.

The cannon may be of a calibre of between 75 mm and 155 mm and the pivoting capacity in traverse of the cradle will advantageously exceed 300°.

The pivoting capacity in elevation may be of between −10° and +70°.

BRIEF DESCRIPTION OF TH DRAWINGS

The invention will become more apparent from the following description of a particular embodiment, such description made with reference to the appended drawing, in which:

FIG. 1 shows a side view of a weapon system according to the invention, the system being shown without the side panels, FIGS. 2*a*, 2*b*, 2*c*, 2*d* and 2*e* show different steps in the set up of the plate by the vehicle, the system being shown without the side panels.

Figure 3A:
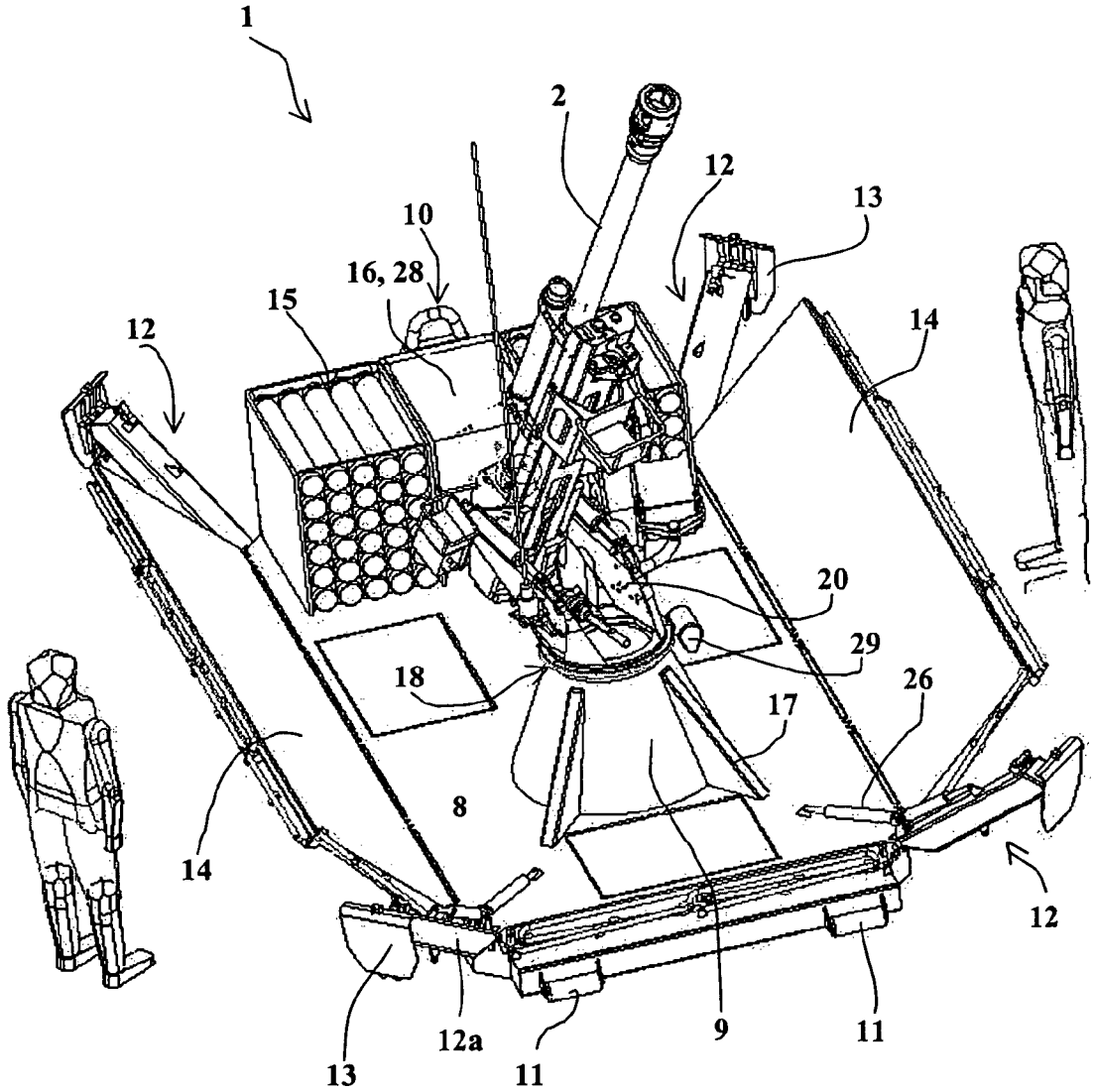
Figure 3B:
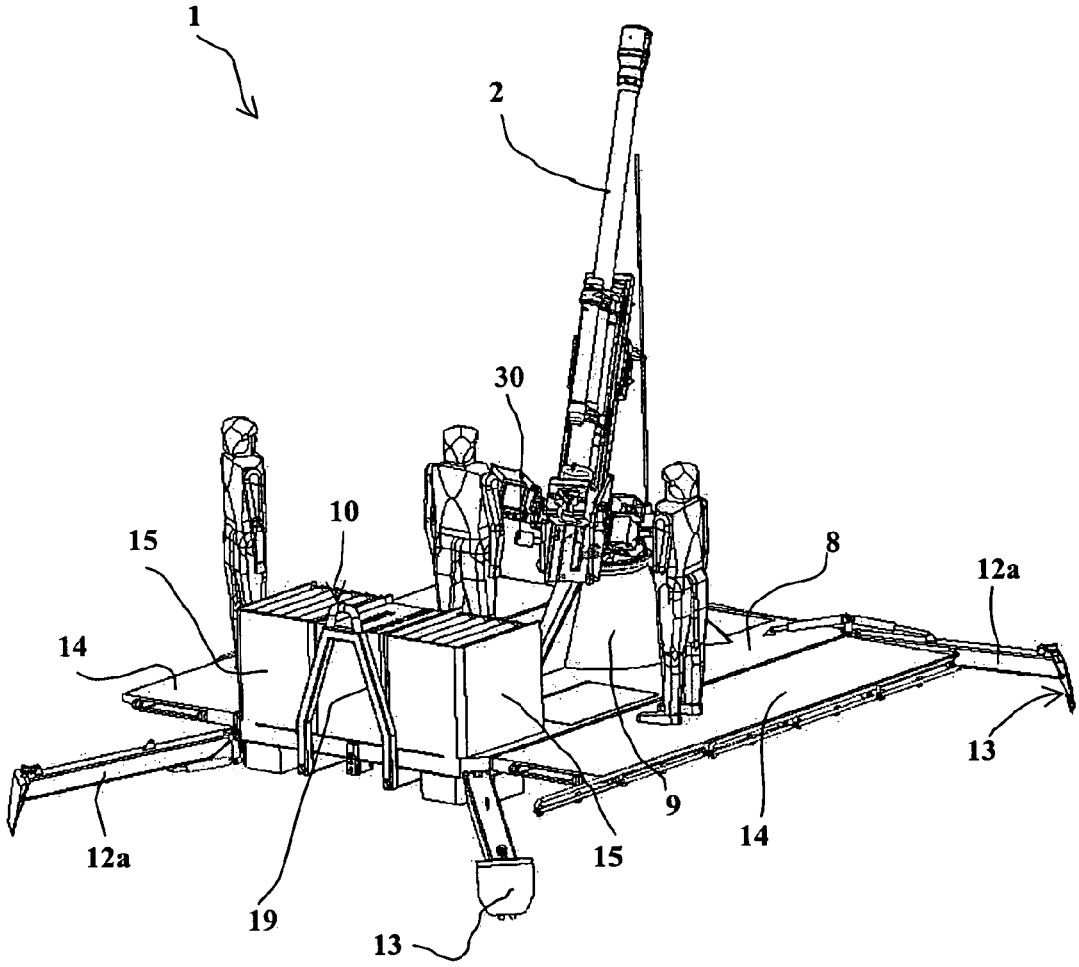
Figure 4A:
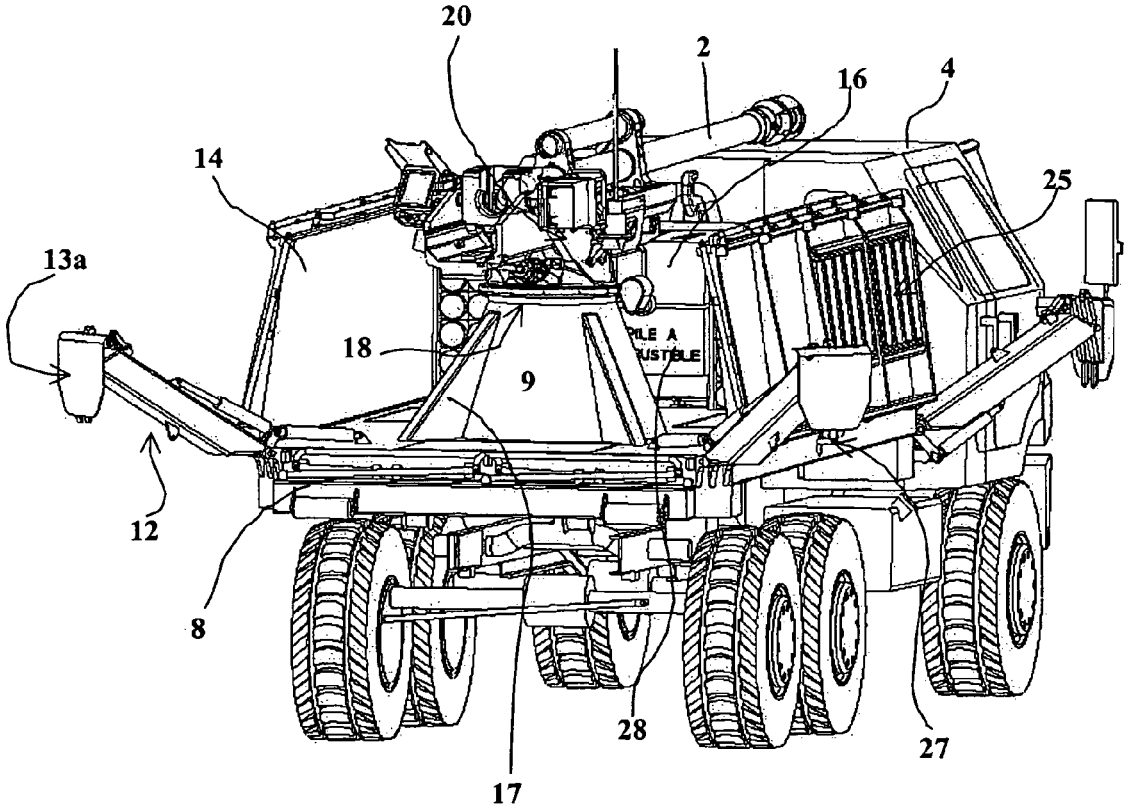
Figure 4B:
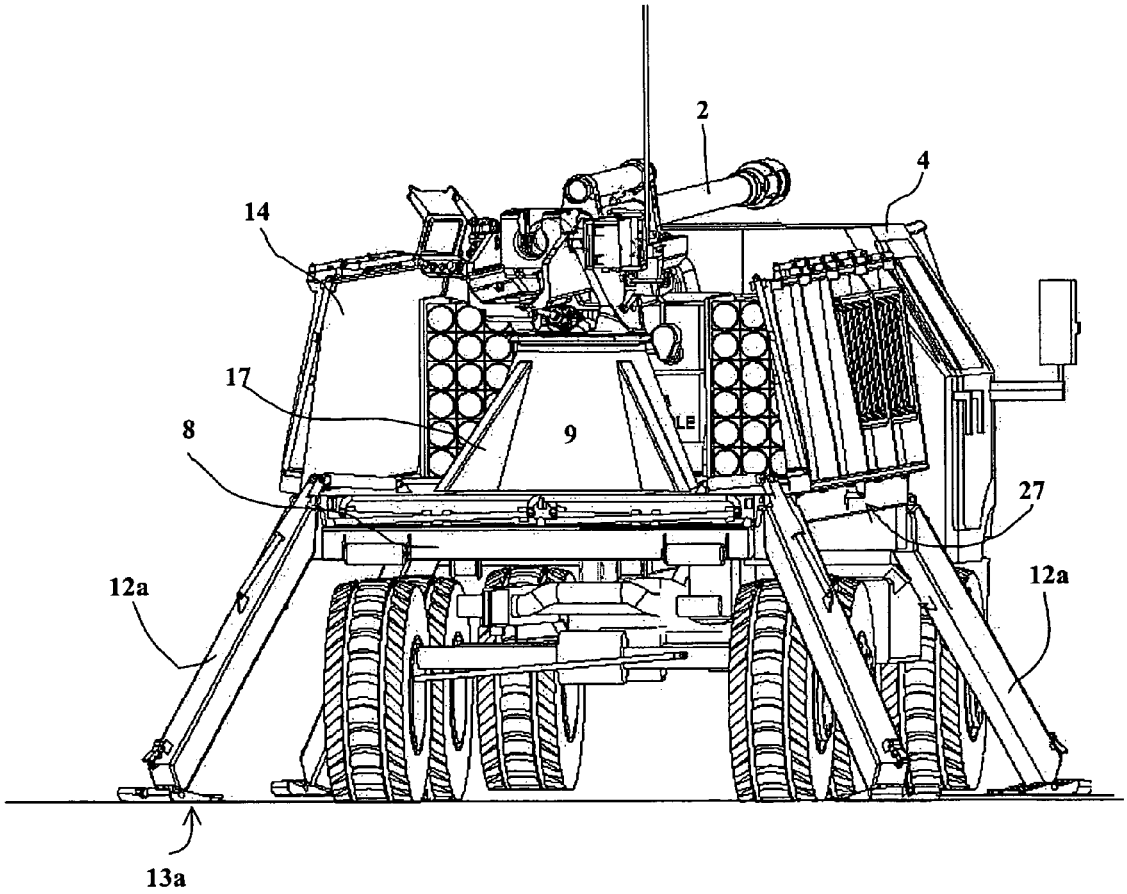
Figure 4C:
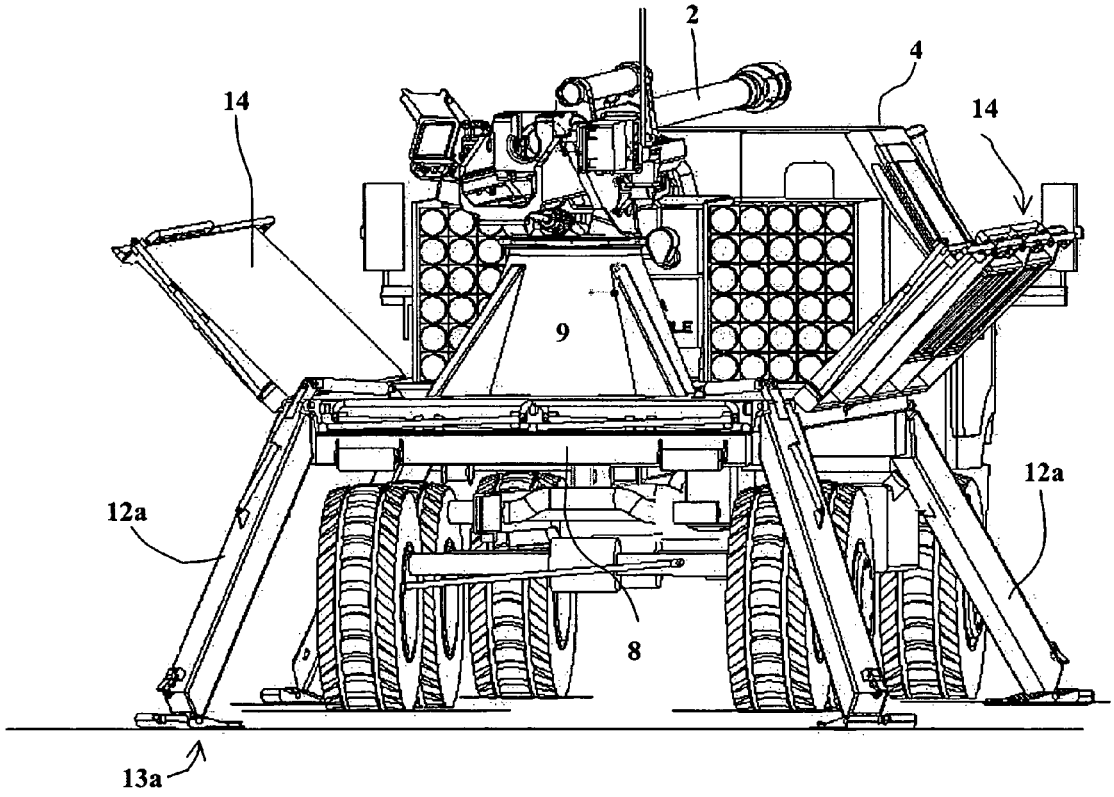
Figure 4D:
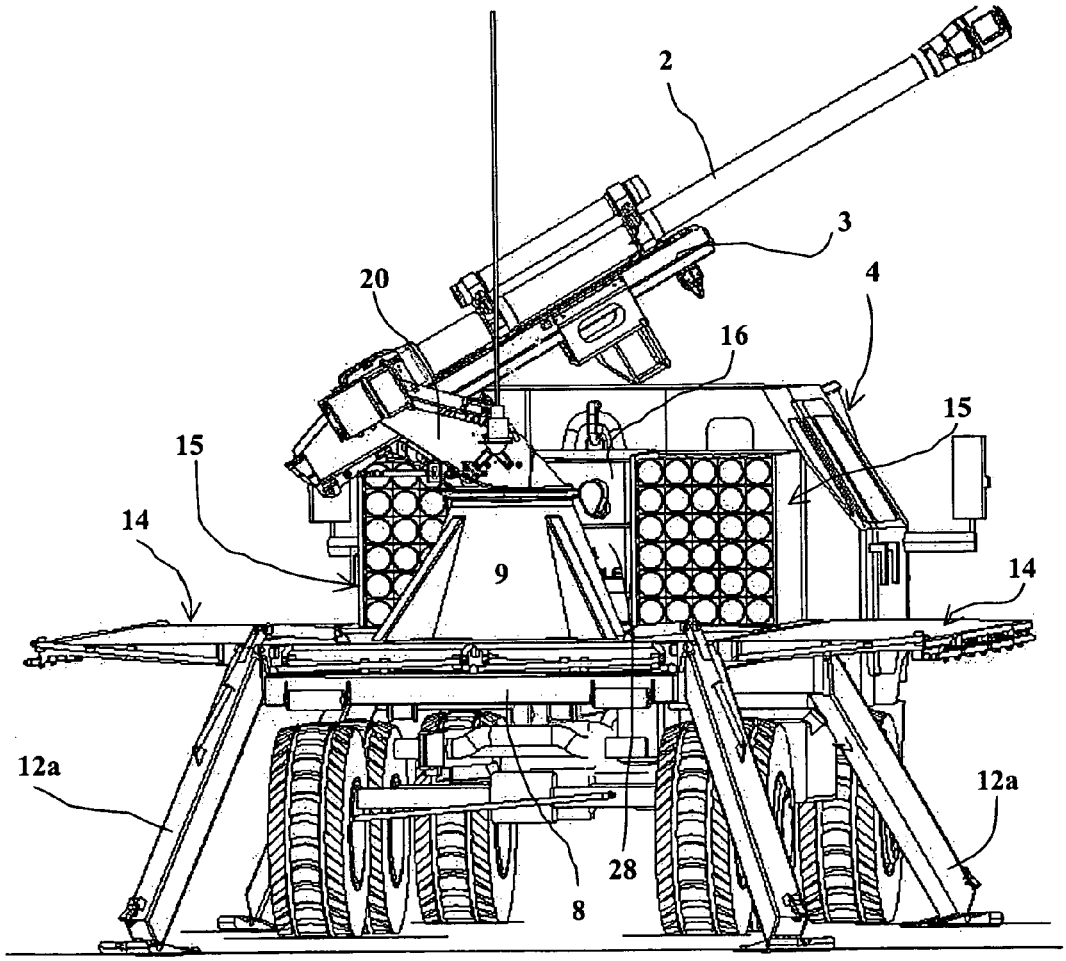
Figure 4E:
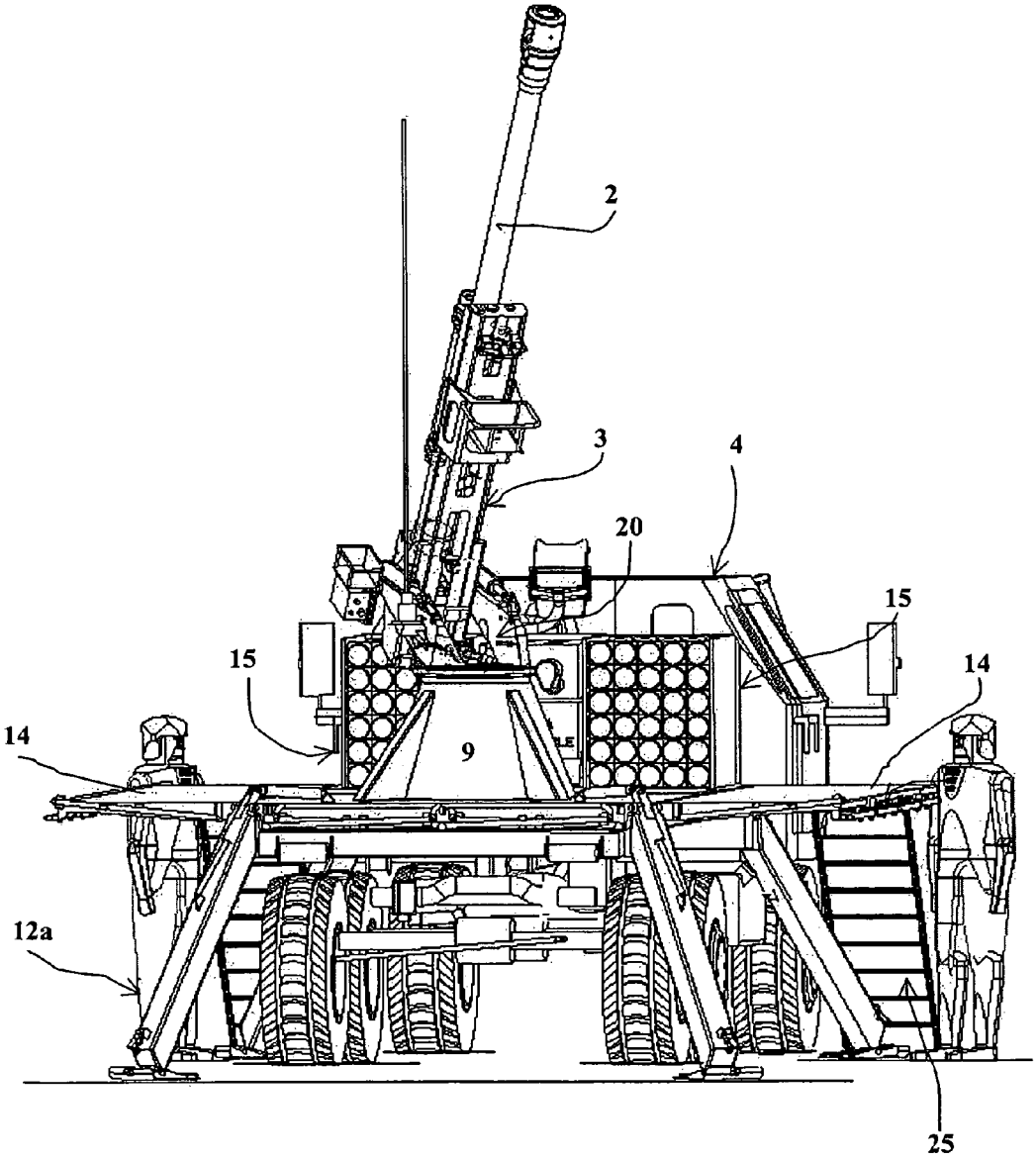
Figure 5A:
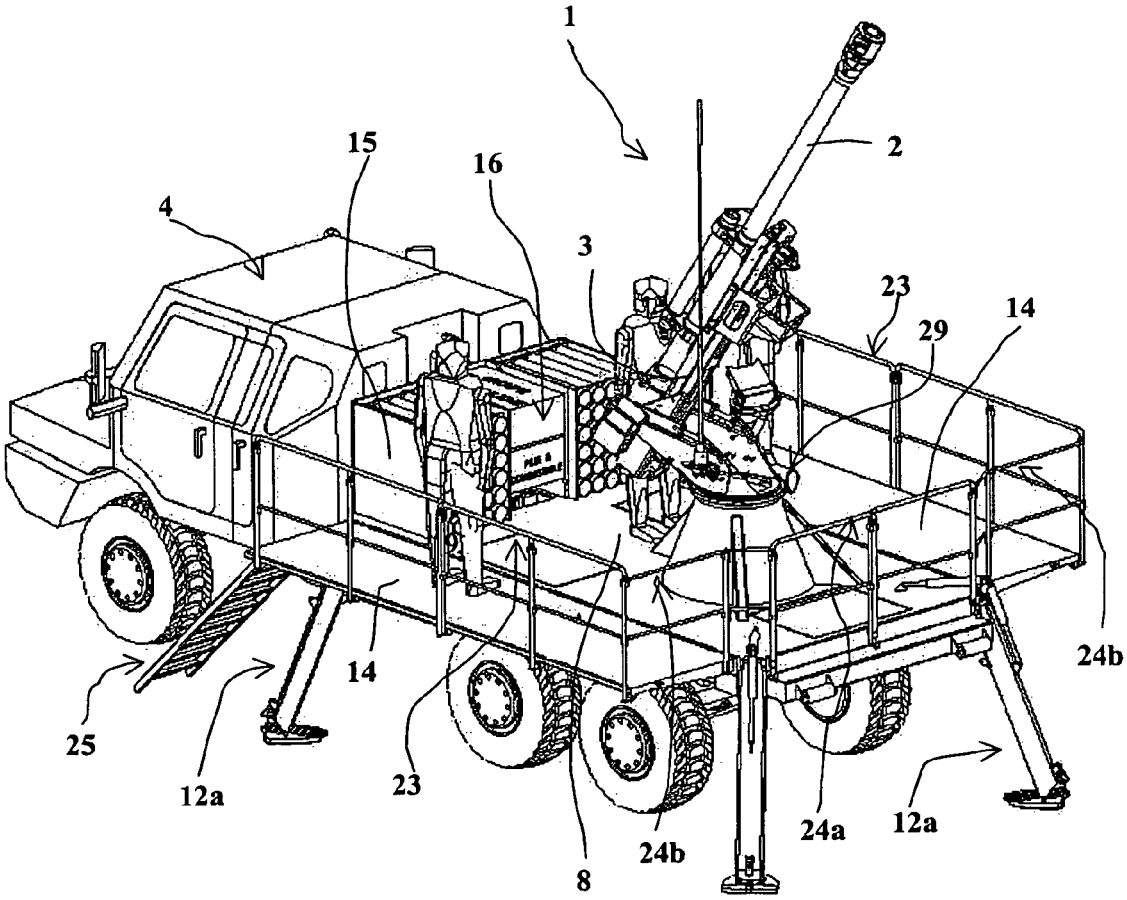
Figure 5B:
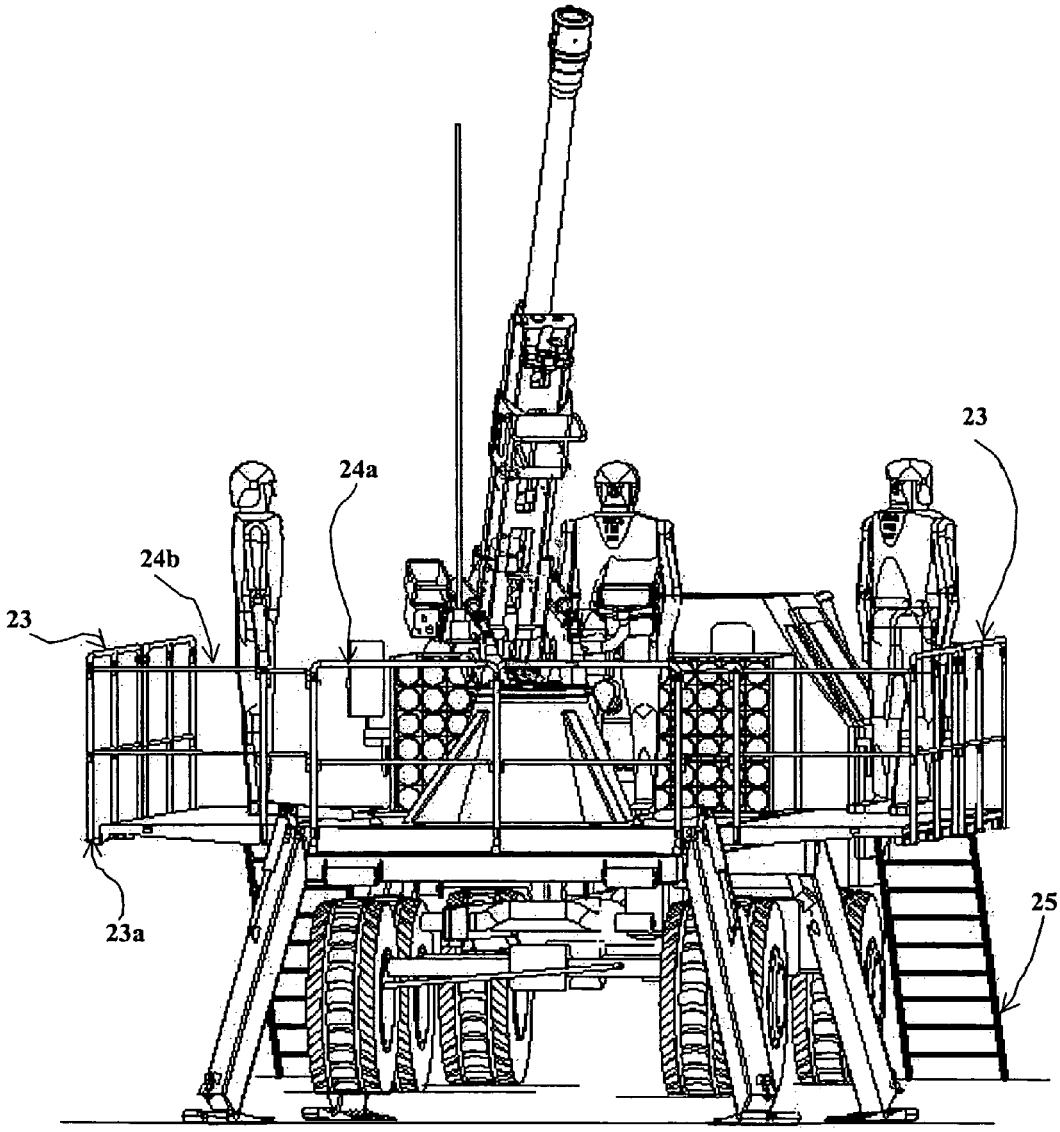
Figure 6A:
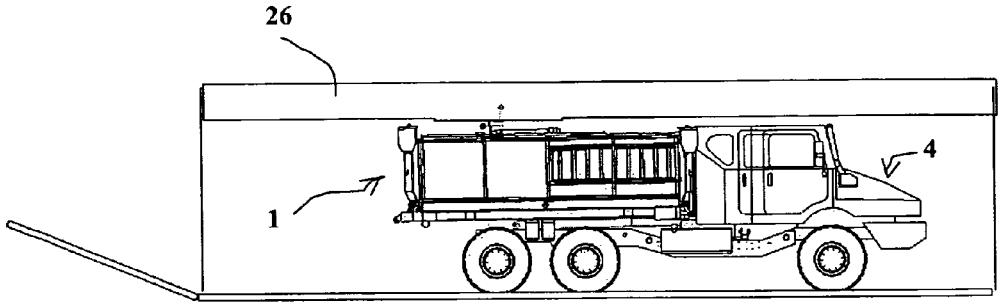
Figure 6B:
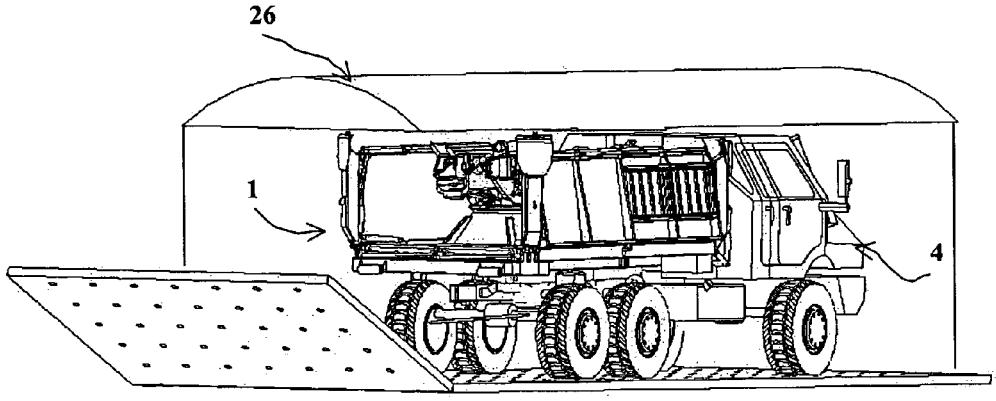
Figure 6C:
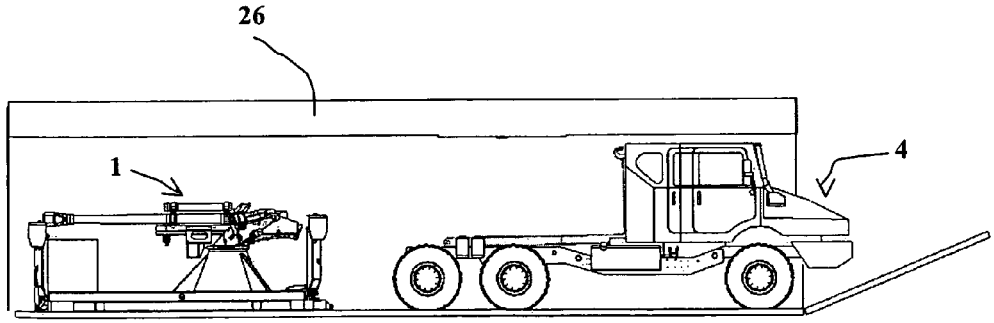

FIGS. 3*a* and 3*b* show subsequent steps in the deployment of the weapon system from the plate positioned on the ground, FIGS. 4*a*, 4*b*, 4*c*, 4*d* and 4*e* show different steps in the deployment of the weapon system when firing from the vehicle, FIGS. 5*a* and 5*b* are two views showing the weapon system ready to fire from the vehicle, FIGS. 6*a*, 6*b* and 6*c* show the installation of the weapon system according to the invention in a transport plane.

DETAILED DESCRIPTION OF PREFERRED EMBODIMENTS

FIG. 1 shows a side view of a weapon system 1 incorporating a cannon 2 mounted in a cradle 3 and intended to be carried on board a vehicle 4. Here, the vehicle is a 6 wheel drive flatbed truck weighing less than 10 tons. These trucks are conventional models and are commonly used in the armed forces, for example to transport logistic containers.

The chassis 5 of the truck has a maneuvering arm 6 which can be moved in a horizontal direction D and which may also pivot around a horizontal shaft 7 to enable a container to be placed on the ground. The arm's movements are controlled by hydraulic jacks which, so as to avoid encumbering the drawing, are not shown.

Such flatbed trucks are conventional. U.S. Pat. No. 4,175,904 and EP12145 describing such trucks may be consulted.

The weapon system 1 according to the invention incorporates a base plate 8 carrying a support 9 onto which the cradle 3 is mounted able to pivot in traverse by means of a fork 20 (see also FIG. 3*a*).

Traverse pivoting of the fork 20 on the support 9 is ensured thanks to a turntable 18 (for example a ball turntable). The cradle 3 is furthermore connected to the fork 20 by trunnions 21 which enable the cradle 3 to pivot in elevation.

The plate 8 is formed by mechanically welded sheet metal reinforced in the lower part by latticed ribbing (not shown).

The plate 8 may be more particularly seen in FIGS. 3*a* and 3*b*. At a front part, it incorporates a bracket 19 with a ring 10 engaged by a hook (not shown) integral with the end of the maneuvering arm 6.

At a rear part, the plate incorporates rollers 11 which facilitate its positioning on the ground as for a classical logistic container.

In accordance with the invention, the plate 8 has a stabilizer 12 at each angle, which is formed by an arm 12*a* able to pivot with respect to the plate 8 and which ends in a spade 13, which is articulated and intended to push into the ground when the ground is loose.

The stabilizers 12 are maneuvered by hydraulic jacks 26. When the plate is in its transport position mounted on the truck (FIG. 1), the stabilizer arms 12*a* are oriented upwards (see FIG. 1).

The plate 8 is rectangular and carries two pivoting panels 14 arranged along the lengths of the plate between the arms 12. These panels are not shown in FIGS. 1, 2*a*, 2*b*, 2*c*, 2*d* and 2*e* but may be seen in the other Figures.

The panels 14 are articulated with respect to the plate 8 and may move from a transport position in which they are substantially perpendicular to the plate 8 (FIG. 4*a*) to a service position in which they are substantially in the prolongation of the plate 8 (FIGS. 3*b*, 4*d*, 5*a*). The panels 14 enable the floor surface of the plate 8 to be increased for the gun crew.

The panels 14 are locked in their folded position by locking means (not shown). Each panel 14 is made to pivot by a horizontal jack 27 placed under the plate 8. Only the end of this jack's rod can be seen in the Figures.

The plate 8 also carries two racks 15 made to house the projectiles and propellant charges. It also has a hydraulic generator unit 16 intended to power the jacks which pivot the stabilizers 12 and panels 14. Finally, it also carries an electric generator 28 enabling the motorizations ensuring control of the pivoting in elevation and in traverse of the cradle 3 and the cannon 2.

The support 9 is solidly fixed to the plate 8. It is of a tapered shape and is laterally reinforced by ribs 17 (FIG. 3*a*). This support 9 carries the turntable 18 which enables the fork 20 to pivot by about 380° around a vertical shaft. This movement is ensured thanks to an electric motor 29 (see FIGS. 3*a* and 5*a*).

The elevation pivoting of the cradle 3 with respect to the fork 20 is controlled by another electric motor 30 (see FIG. 3*b*). The amplitude of elevation pivoting is of between −10° and +70° with respect to a horizontal plane passing through the trunnions 21.

Electronic means (not referenced in the Figures) enables firing control. These means are classical and comprise: a firing computer incorporating ballistic data, a global positioning system (GPS) coupled with an inertial unit and means to communicate with a command post. These means are coupled with the electric motors and enable the rapid laying of the cannon so as to ensure the firing ordered by the command post.

The weapon system according to the invention presents a first advantage of constituting an entirely autonomous assembly carrying on a single plate 8: the cannon, the charges and projectiles as well as the hydraulic and electric generators and the firing control means.

In accordance with a first embodiment of the invention, this weapon system may be used from the plate 8 positioned on the ground.

FIGS. 2*a* to 2*e* show the different stages involved in placing the plate 8 on the ground. These stages are conducted in an identical manner to those enabling the positioning on the ground of a logistic container.

Figure 2A:
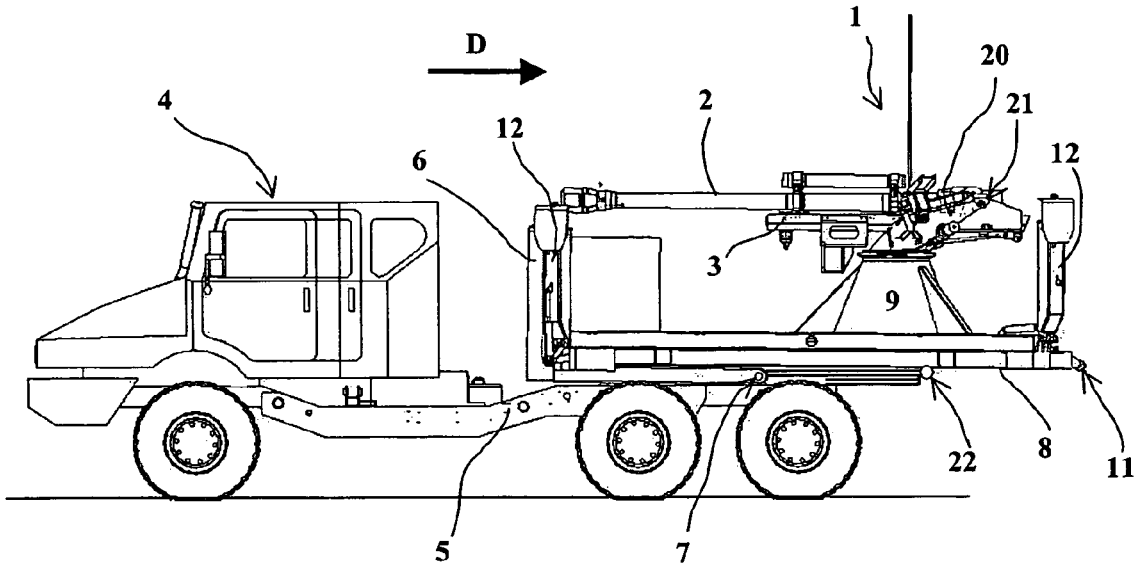
Figure 2B:
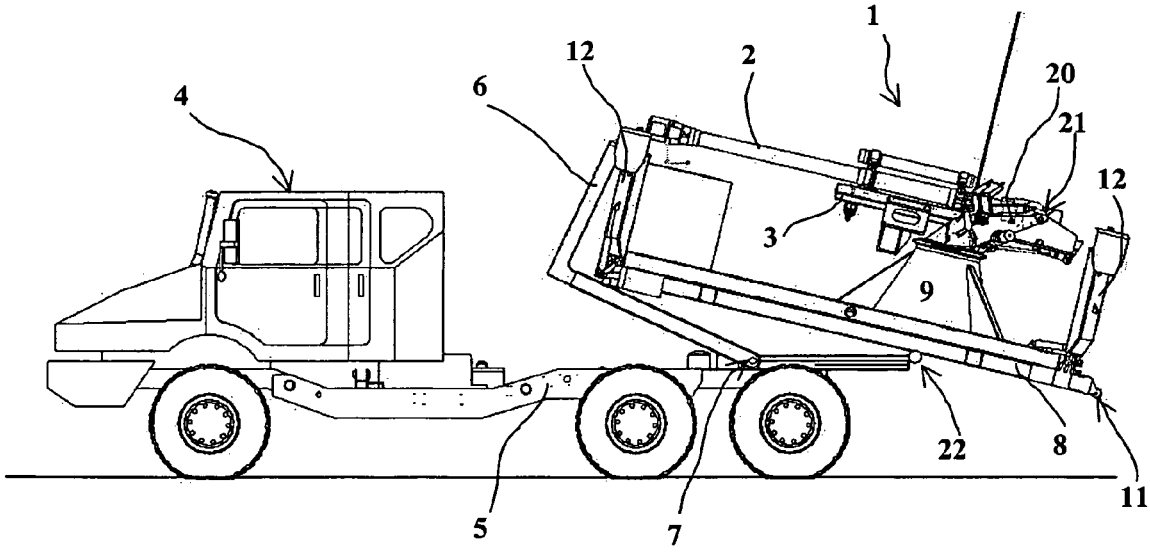
Figure 2C:
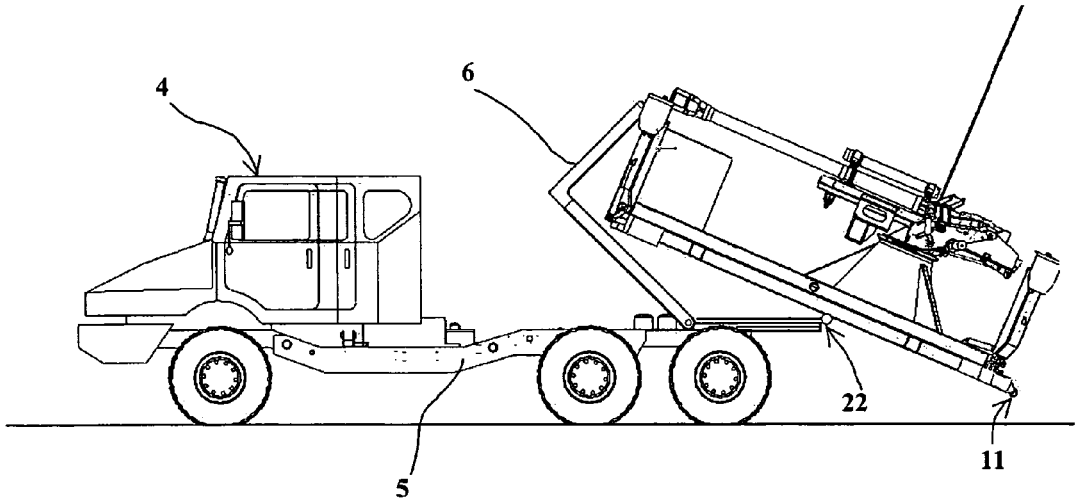
Figure 2D:
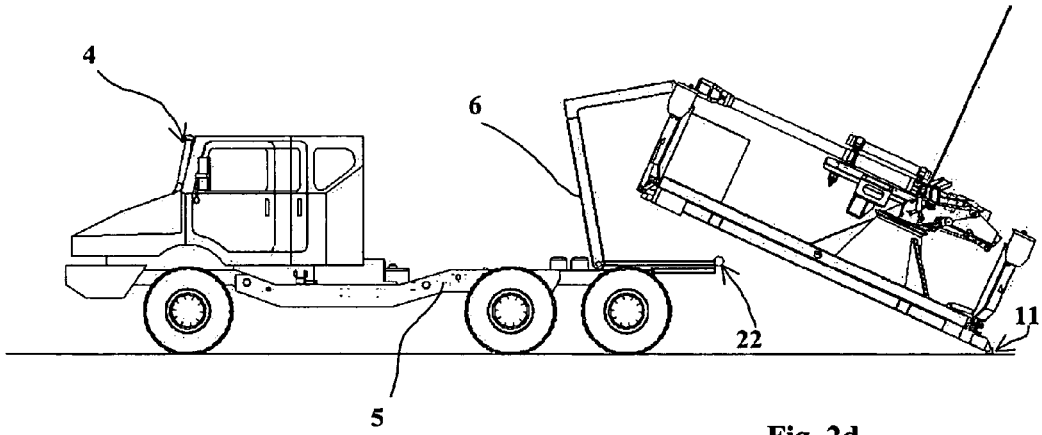

Firstly, the maneuvering arm pushes the plate 8 in direction D towards the rear of the vehicle 2 (FIG. 2*a*). During this stage the plate rolls on rollers 22 fitted on the rear part of the chassis 5.

Figure 2E:
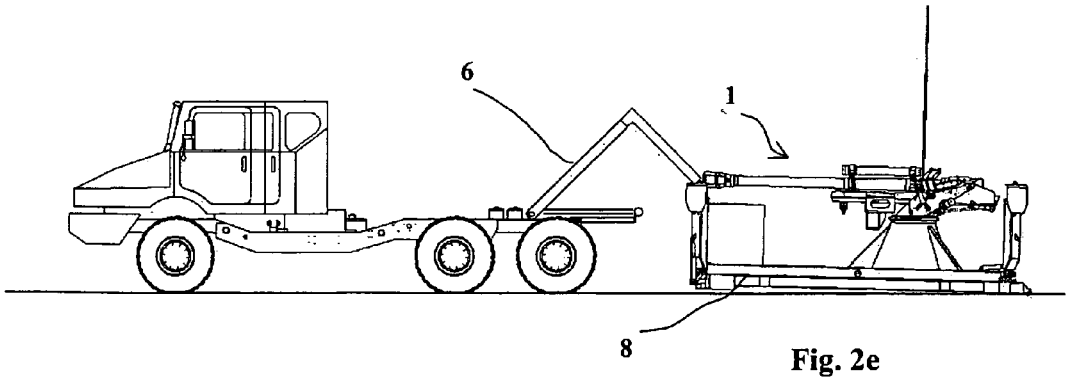

Then, the maneuvering arm is made to pivot (FIGS. 2*b*, 2*c*, 2*d*) so as to lay the plate 8 on the ground (FIG. 2*e*).

Once the plate 8 has been laid on the ground, the vehicle 4 can move away and the deployment of the weapon system continues with (FIG. 3*a*) the pivoting of the stabilizer arms 12 and the deployment of the lateral panels 14.

The weapon system 1 is now ready to fire (FIG. 3*b*).

The substantial surface area of the plate 8 in contact with the ground added to the support given by the stabilizer arms 12 ensures firing stability even on relatively loose ground. Firing can be carried out at a variety of elevation angles without problems of misalignment and without moving the weapon system. The 380° pivoting capacity allows any type of action to be undertaken whatever the position of the plate on the ground. It is thus no longer necessary for the orientation of the plate to be accurately determined when placing it on the ground.

It is thus possible for such a weapon system to be very rapidly put into action. Deployment takes less than one minute and the system can engage a target less than thirty seconds after being placed on the ground.

The weapon system according to the invention may also be implemented directly from the vehicle 4.

For this, the arms 12*a* have a length and pivoting capacity selected so as to enable the spades 13 to press on the ground with the plate 8 is carried on the vehicle 4.

For this, telescopic arms 12*a* will be defined whose length is able to adapt to the ground's unevenness. The arm's variations in length will be controlled by hydraulic jacks (not shown) also powered by the hydraulic generator unit 16.

The spades 13 are mounted able to pivot at the end of the arms 12*a*. They incorporate a plane external surface 13*a* which enables them to form a surface with which the ends of the arms 12*a* can press on the ground.

FIGS. 4*a* to 4*e* show the different stages of a weapon system according to the invention being brought into action directly from the vehicle 4.

Firstly, the arms 12*a* are made to deploy (FIG. 4*a*). The ends of the arms 12*a* come to bear on the ground via the spades 13 (FIG. 4*b*). The plate 8 thus presses directly on the ground without causing stresses to the vehicle 4 during firing. The vehicle's axles are thus relieved of the load of the weapon system.

Thereafter, the lateral panels 14 are deployed (FIG. 4*c*) and take up their service position (FIG. 4*d*) in which they are substantially in the prolongation of the plate 8. Naturally, locking means (not shown) ensure that the panels 14 are safely held in their service position.

According to another characteristic of the invention, at least one guardrail 23 is provided on each panel 14. The guardrails may be put away in appropriate housing made under the panels 14.

The guardrails will be classically made of welded tubes. The lower ends 23*a* of such tubes will be housed in matching gussets on the panels 14 (FIG. 5*b*). Hinges may also be provided between the guardrails and the panels. These hinges would enable the guardrails to be pivoted from a storage position (in which they would be fastened to a lower face of the panel) and a service position in which they are perpendicular to the panel 14 when said panel is itself in its service position.

The guardrails may also be divided into several light foldable structures housed at the ends of the panels 14 (in order to optimize their volume).

FIGS. 5*a* and 5*b* show the guardrails 23 in position. They make it safer for the crew to work on the plate 8 extended by the panels 14.

As may be seen in FIGS. 5*a* and 5*b*, one or several guardrails 24*a* may also be provided to make the rear part of the plate 8 safer and guardrails 24*b* may be provided over the width of the panels 14 to connect guardrails 23 and 24*a*.

Lastly, one or two service ladders 25 make access to the plate 8 easier. Each ladder will be put away under a panel (see FIG. 4*a*).

The deployment of the weapon system for firing from a vehicle takes less than one minute. This mode is more particularly implemented when a change of position must be made rapidly after firing.

Note that the vehicle is subjected to practically no firing stresses since these are taken up by the arms 12. The vehicle may thus be a standard logistic truck.

Moreover, the firing capacities in elevation and in traverse are the same as for the system when positioned on the ground.

The operational possibilities of the system proposed by the invention are thus vast.

Lastly, FIGS. 6*a* and 6*b* illustrates a vehicle 4 equipped with a weapon system 1 according to the invention. Its volume is reduced. The overall height of the weapon system 1 is less than that of the driver's cab 4. The assembly has a mass of around 5 tons for a calibre of 105 mm. It may easily be carried onboard a C130 type carrier plane 26 (produced by Lockheed). Moreover, as shown in FIG. 6*c*, it is possible for the vehicle 4 and one or several weapon systems 1 to be carried as separate loads. The weapon systems may also be parachuted down to firing positions. They constitute full, autonomous systems, equipped with their ammunition and hydraulic and electric power sources. They may then be transported in the field by logistic vehicles already in place.

What is claimed is:

1. A weapon system comprising:

a base plate for being mounted on a vehicle, a cradle mounted on said base plate, a cannon mounted in said cradle, and a plurality of stabilizers connected to said base plate, wherein the cannon is placeable in a ground firing position by moving said base plate from a vehicle to the ground using a maneuvering arm, and wherein the plurality of stabilizers are pivotable into a substantially horizontal position and are for stabilizing the base plate when the cannon is in such ground firing position by extending outwardly from the base plate and contacting the ground.

2. A weapon system according to claim 1, further comprising a support mounted to said base plate, wherein said cradle is mounted on and pivotable with respect to said support, and said support is fixed with respect to said base plate.

3. A weapon system according to claim 1, wherein said stabilizers comprise arms of a predetermined length and pivoting capacity such that when said plate is mounted on said vehicle and said stabilizers are extended, respective ends of said stabilizer arms touch the ground.

4. A weapon system according to claim 1, further comprising at least one panel connected to said plate and pivotable between a transport position in which it is substantially perpendicular to said plate, and a deployed position in which it is substantially an extension of said plate.

5. A weapon system according to claim 4, further comprising at least one guardrail for being connected to each panel in a perpendicular position to said panel when the panel is in its deployed position.

6. A weapon system according to claims 5, further comprising at least one of a projectile rack and a propellant charge rack.

7. A weapon system according to claim 6, further comprising a driving means for pivoting said cradle with respect to said support, and at least one generator for supplying power to said driving means.

8. A weapon system according to claim 1, wherein said cannon is of a calibre of between 75 mm and 155 mm and wherein said cradle has a pivoting capacity in traverse which exceeds 300°.

9. A weapon system according to claim 8, wherein said cannon has a pivoting capacity in elevation of between −10° and +70°.

* * * * *